US005778705A

United States Patent [19]

Lee

[11] Patent Number: 5,778,705

[45] Date of Patent: Jul. 14, 1998

[54] MOTORIZED APPARATUS WITH AN APPARATUS FOR AUTOMATICALLY OPENING AND CLOSING THE DOOR

[75] Inventor: Young Su Lee, Suwon, Rep. of Korea

[73] Assignee: Samsung Electronics Co., Ltd., Suwon, Rep. of Korea

[21] Appl. No.: 712,846

[22] Filed: Sep. 12, 1996

[30] Foreign Application Priority Data

Nov. 9, 1995 [KR] Rep. of Korea ..... 1995 32794 U

[51] Int. Cl.[6] ..... D06F 37/28

[52] U.S. Cl. ..... 68/196; 68/12.26

[58] Field of Search ..... 68/12.26, 23 R, 68/139, 196; 134/57 DL, 58 DL; 292/DIG. 69; 192/136; 210/146; 160/4, 188; 49/263, 357; 200/61.89, 86.5

[56] References Cited

U.S. PATENT DOCUMENTS 3,364,621 1/1968 Erickson ..... 49/263

5,546,773 8/1996 Lee ..... 68/196

FOREIGN PATENT DOCUMENTS 853146 7/1949 Germany ..... 68/12.26

851490 10/1960 United Kingdom ..... 210/146

*Primary Examiner*—Philip R. Coe

*Attorney, Agent, or Firm*—Burns, Doane, Swecker & Mathis, L.L.P.

[57] ABSTRACT

A washing machine includes a housing having a top opening, and a spin basket disposed in the housing. A door is mounted on the housing for opening and closing the top opening. A motor-actuated door opening/closing mechanism is provided for opening and closing the door, the mechanism being actuated by a foot pedal mounted at a lower portion of the housing. By pivoting the foot pedal, an electric signal is generated for actuating a motor of the door opening/closing mechanism.

8 Claims, 6 Drawing Sheets

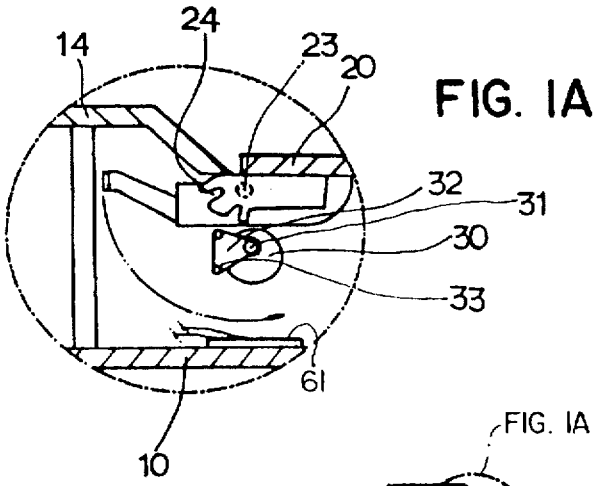
FIG. 1A
FIG. 1
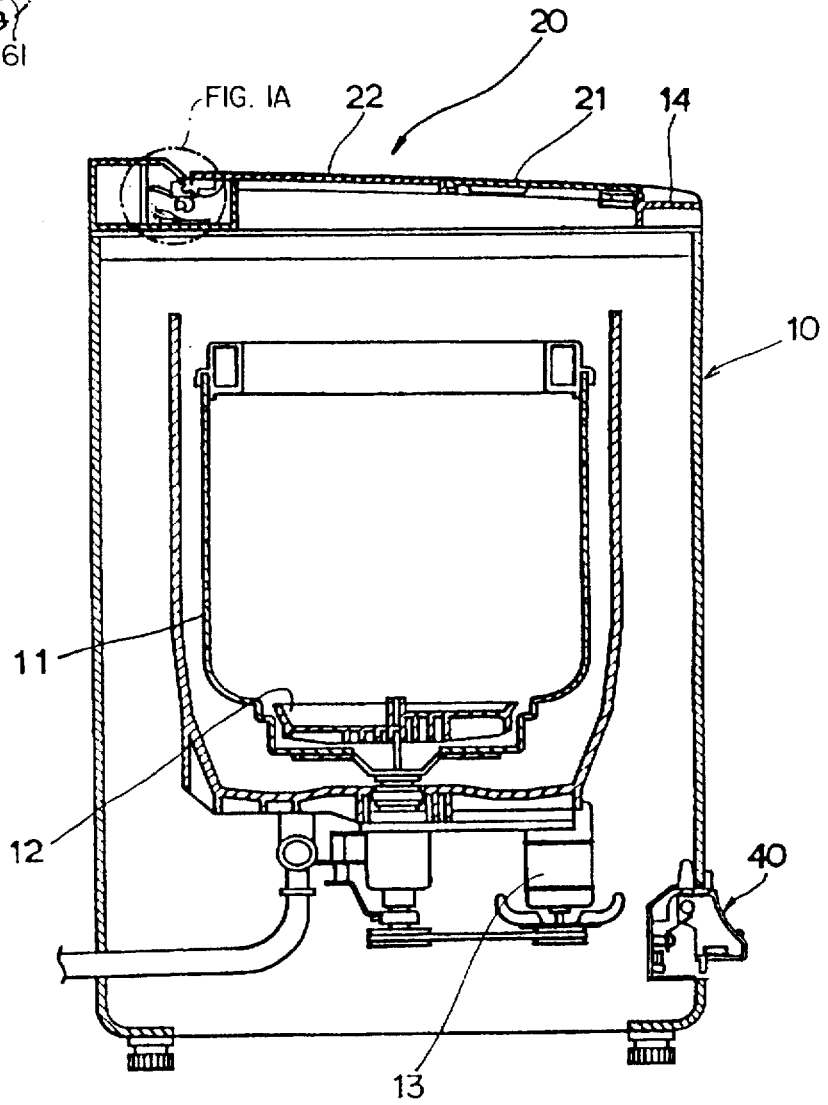

MOTORIZED APPARATUS WITH AN APPARATUS FOR AUTOMATICALLY OPENING AND CLOSING THE DOOR

BACKGROUND OF THE INVENTION

1. Field of the Invention

The present invention relates to a washing machine. More particularly, it relates to a washing machine with an apparatus for automatically opening and closing the door of the washing machine.

2. Discussion of Related Art

Although an electric washing machine is a complex mechanism, its working principles are simple. The electric washing machine has a pulsator inside of a spin basket, and the pulsator is driven by an electric motor to create a particular current of water. The bundle of laundry is gently turned through the water as the agitator turns so that soil can be removed from the laundry by agitation. The electric washing machine is equipped with a microcomputer for automatically performing the overall laundering processes in one basket under the control of a program timer. Thus, it automatically goes through the steps of removing dirt from laundry, rinsing it and then spinning out the water, leaving the laundry damp dry.

FIG. 6 depicts a perspective view of a conventional washing machine.

As shown in FIG. 6, a housing 10 of the washing machine includes a spin basket 11 into which water, detergent and articles to be washed are put for washing, rinsing and hydro-extracting processes, and a pulsator 12 installed on the bottom of the spin basket 11.

The spin basket 11 is designed to have an opening on the upper part, and a door 20 is provided on the top of the housing 10 by which the spin basket 11 is opened or closed. The door 20 is formed to turn on its hinges formed at the rear end, and has front and rear panels 21 and 22 coupled to each other. As the door 20 is opened, the front panel 21 can be folded toward the backside of the rear panel 22. The rear panel 22 of the door 20 is designed to have a back end joined to the body 10 so as to swing therearound. The front panel 21 has a handle 25 which facilitates the closing and opening of the door 20. The door of such a conventional washing machine can only be manually operated and it is inconvenient to use. Usually, users wash a large amount of clothing or fabrics at a time in a washing machine so as to increase efficiency of laundering, and it is difficult for them to open the door of the washing machine with his/her hands while holding a heavy basket in which the articles to be washed are contained. Therefore, they must bear the trouble of opening the door of the washing machine after putting down the basket of laundry on the floor and then raising it again to put the laundry into the washing machine.

Besides, since washing machines are commonly placed in relatively-small spots in the home, it is not easy to secure a suitable space for the basket of laundry, so it is inconvenient for housewives to use them.

SUMMARY OF THE INVENTION

Accordingly, the present invention encompasses a washing machine with an apparatus for automatically opening and closing the door of the washing machine to thereby obviate the above-mentioned problems due to limitations and disadvantages of the conventional art.

It is an object of the present invention to provide a washing machine having an apparatus which can be easily operated with the foot to automatically open and close the door of the washing machine.

According to one aspect of the present invention, the present invention involves a washing machine with a housing containing a spin basket whose upper part is opened, a door for opening and closing the entrance of the spin basket, an opening/closing device for automatically opening and closing the door, and a control device for controlling the opening/closing device, and the washing machine includes a manipulation device installed in the housing and controlled to transmit a signal for opening and/or closing the door to the control device.

The manipulation device is installed in a recess formed on the lower part of the housing of the washing machine and can be controlled with the foot of a user. This manipulation device includes a switch for generating an electric signal and movable means which activates or deactivates the switch. The movable means has a pedal which pivots on one point, pivot pins which are provided on the upper part of the pedal and on which the pedal rotates, and an elastic member that elastically supports the pedal and allows the pedal to be restored to its original state.

The switch includes a reed switch that is mounted on the inner wall of the recess, and a permanent magnet which is provided to the lower part of the pedal and comes close to or is away from the reed switch in response to the operation of the pedal so as to activate or deactivate the reed switch.

The movable means also includes a guide member of a substantially circular-arc shape which guides with restraint the upper end of the pedal in order to prevent a change in the center of rotation of the pedal when the pedal is operated. On the bottom of the pedal there is provided a vertical protrusion that extends toward the bottom of the recess and serves to prevent dirt from getting into the interior of the recess, moving with the rotation of the pedal.

It is to be understood that both the foregoing general description and the following detailed description are exemplary and explanatory and are intended to provide further explanation of the invention as claimed.

BRIEF DESCRIPTION OF THE ATTACHED DRAWINGS

FIG. 1 depicts a side-sectional view of a washing machine in accordance with the present invention;

FIG. 1A is a fragmentary view of a portion of a door of the washing machine show in FIG. 1.

DETAILED DESCRIPTION OF PREFERRED EMBODIMENT

Figure 2:
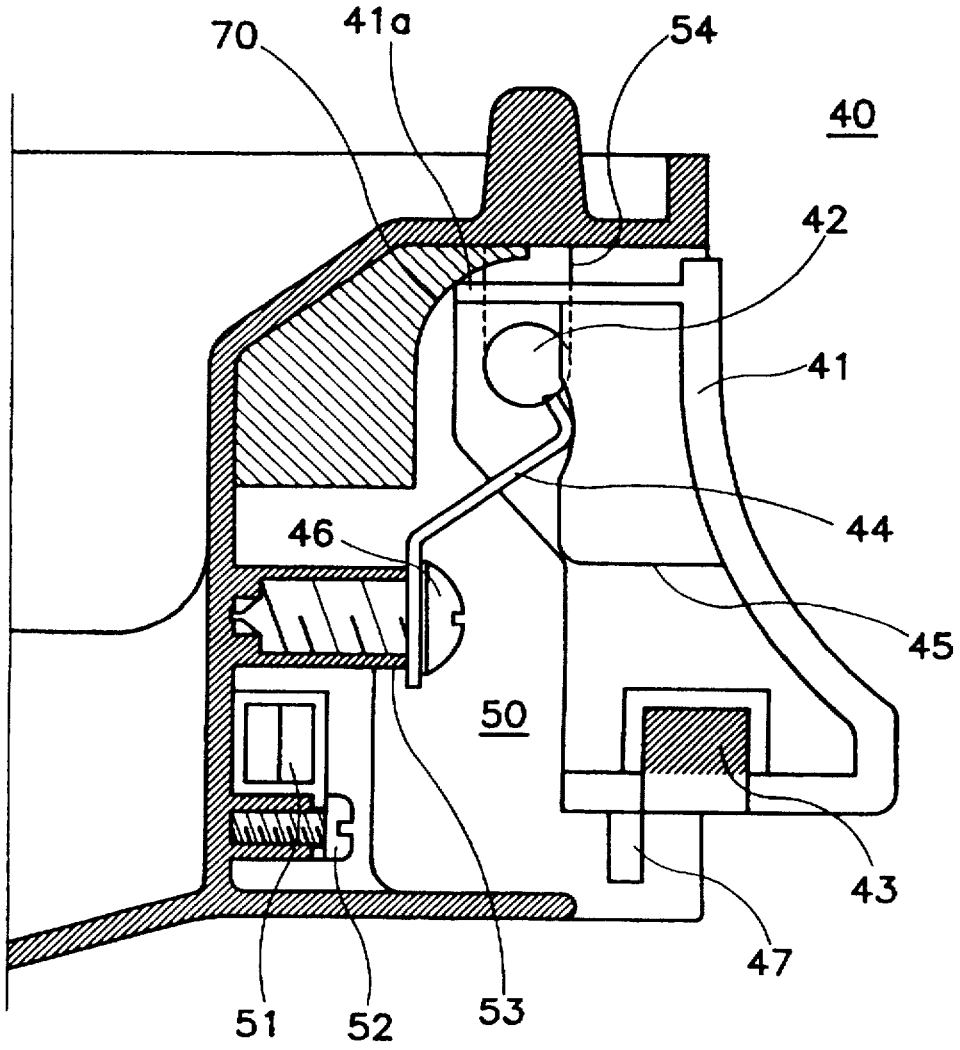
FIG. 2 is an enlarged-sectional view of an apparatus for automatically opening and closing the door of the washing machine in accordance with the present invention, and illustrates the apparatus in a rest condition.

A preferred embodiments of the present invention will be now described in detail with reference to the accompanying drawings. Throughout the drawings and the specification, similar reference numerals denote similar elements.

FIG. 1 depicts a side-sectional view of a washing machine with an apparatus for automatically opening and closing the door in accordance with the present invention.

As shown in FIG. 1, a housing 10 of the washing machine includes a spin basket 11 which is designed to have an opening on the upper part, a pulsator 12 which is rotatably formed on the bottom of the spin basket 11 to create a current of water, and an electric motor 13 that is positioned under the spin basket 11 and serves to drive the spin basket 11 and the pulsator 12.

On the top of the washing machine are provided a control panel containing various control buttons (not illustrated), an upper cover 14 in which a microcomputer (not illustrated) is installed so as to automatically control a set of laundering processes, and a door 20 formed on the upper cover 14 to open and close the entrance of the spin basket 11.

The door 20 consists of front and rear panels 21 and 22 joined together in order that the front panel 21 is folded back against the rear panel 22. The rear panel 22 and the upper cover 14 are hinged together at the back end of the rear panel, and the front panel 21 is hingedly connected to the rear panel 22 to freely move up and down so that the door 20 can be opened and closed.

An electric motor 30 is installed near a hinge 23 of the door 20 in the upper cover 14 in order to move the door 20. A cam-like rotary member 32 is fixedly provided to a motor axis 31 of the electric motor 30, and a pair of projections 33 are formed on the rotary member 32. These projections 33 are spaced from each other by a predetermined distance. The door includes a plurality of grooves 24 into which the projections are adapted to enter. Accordingly, as the electric motor 30 is driven, the rotary member 32 rotates forward or backward, and the projections 33 of the rotary member 32 enter respective grooves 24 sequentially to thereby carry out the opening and closing operations of the door 20 of the washing machine.

Figure 5:
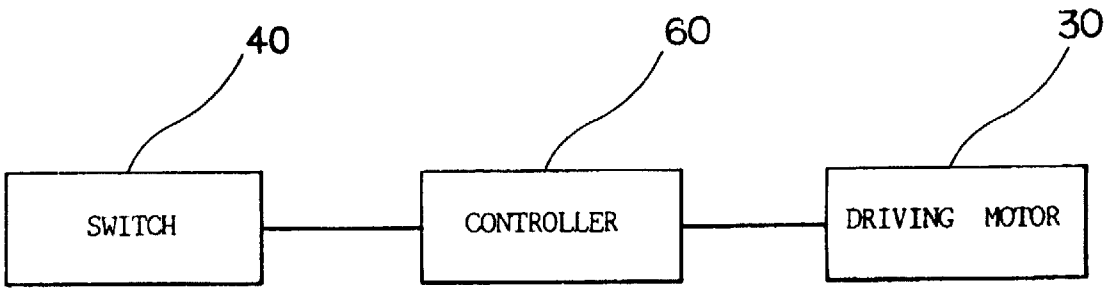
FIG. 5 is a block diagram of a switch controlling section in accordance with the present invention.
Figure 6:
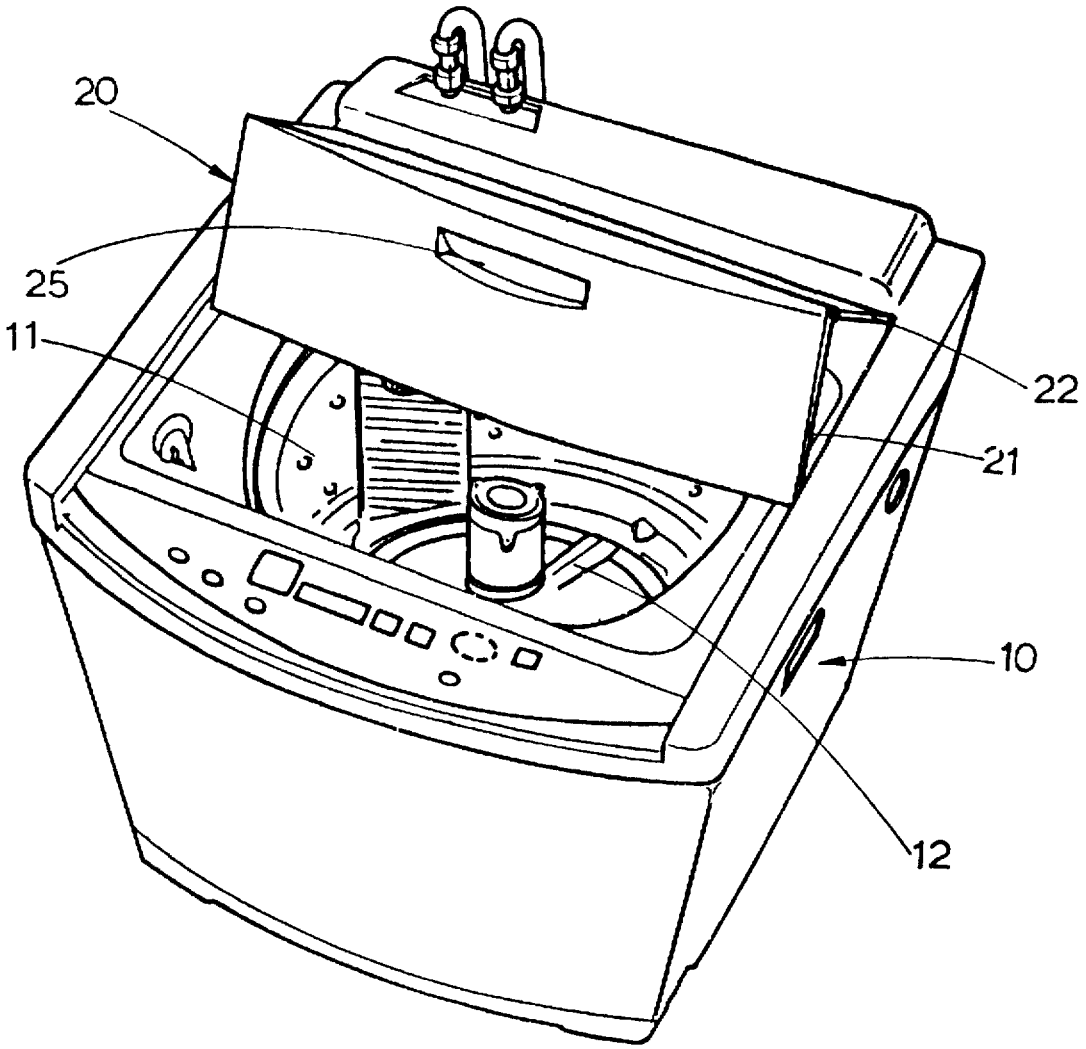
FIG. 6 (PRIOR ART)
FIG. 6 is a top perspective view of a conventional washing machine.

The opening and closing operations of the door 20 can be automatically performed as the electric motor 30 is driven by a control device (not illustrated) that controls the opening and closing operations of the door 20 upon receipt of the door opening/closing signal produced by a manipulation device 40 that will be discussed later. As shown in FIG. 5, the door opening/closing signal from a reed switch 51 of the manipulation device 40 is transmitted to a controller 60, and an output signal of the controller 60 is applied to the electric motor 30. The electric motor 30 is driven forward or backward in response to the output signal of the controller 60 so that the door 20 can be automatically moved out of its current state, i.e., the door would be either opened or closed.

Figure 3:
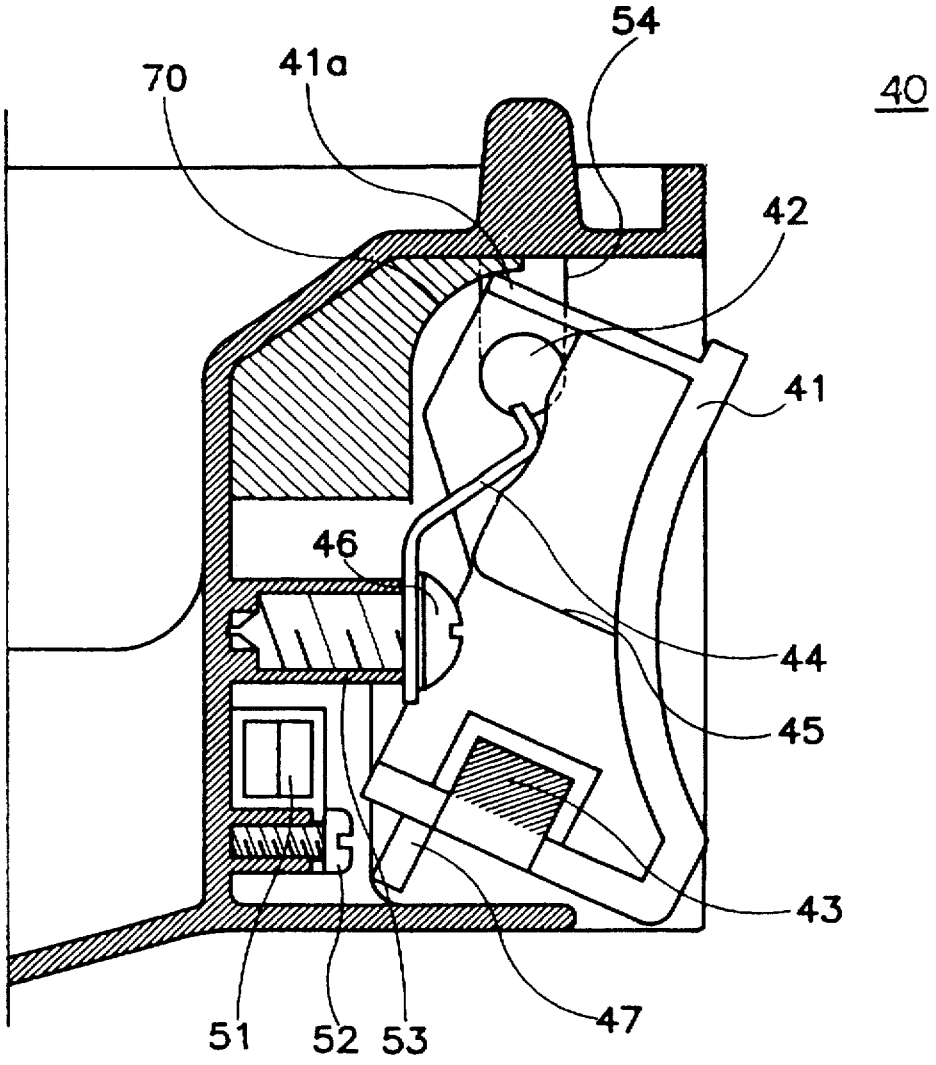
FIG. 3 is an enlarged-sectional view of the inventive apparatus of FIG. 2 for illustrating its operation.

Referring to FIGS. 2 and 3, the manipulation device 40 will be now described.

The manipulation device 40 is installed on the front of the lower part of the housing 10 in order to allow a user to control it with his foot. On the front of the lower part of the housing 10 is provided a recess 50 in which the manipulation device 40 is installed. This recess 50 is formed to have an opening on the front, and the reed switch 51 is mounted on the inner wall of the recess 50.

The reed switch 51 which is not depicted in detail in the drawing, is a magnetic proximity switch formed by sealing press-treated contact points in a tube together with an inert gas. These contact points are designed to come into contact with or be detached from each other by a magnetic material. The reed switch 51 is formed by molding and is fixedly mounted on the inner wall by the use of a screw 52. The reed switch 51 is described in this preferred embodiment by way of example, and another type of a switch such as a micro-switch or non-contact switch may be employed in lieu of for the switch 51.

Figure 4:
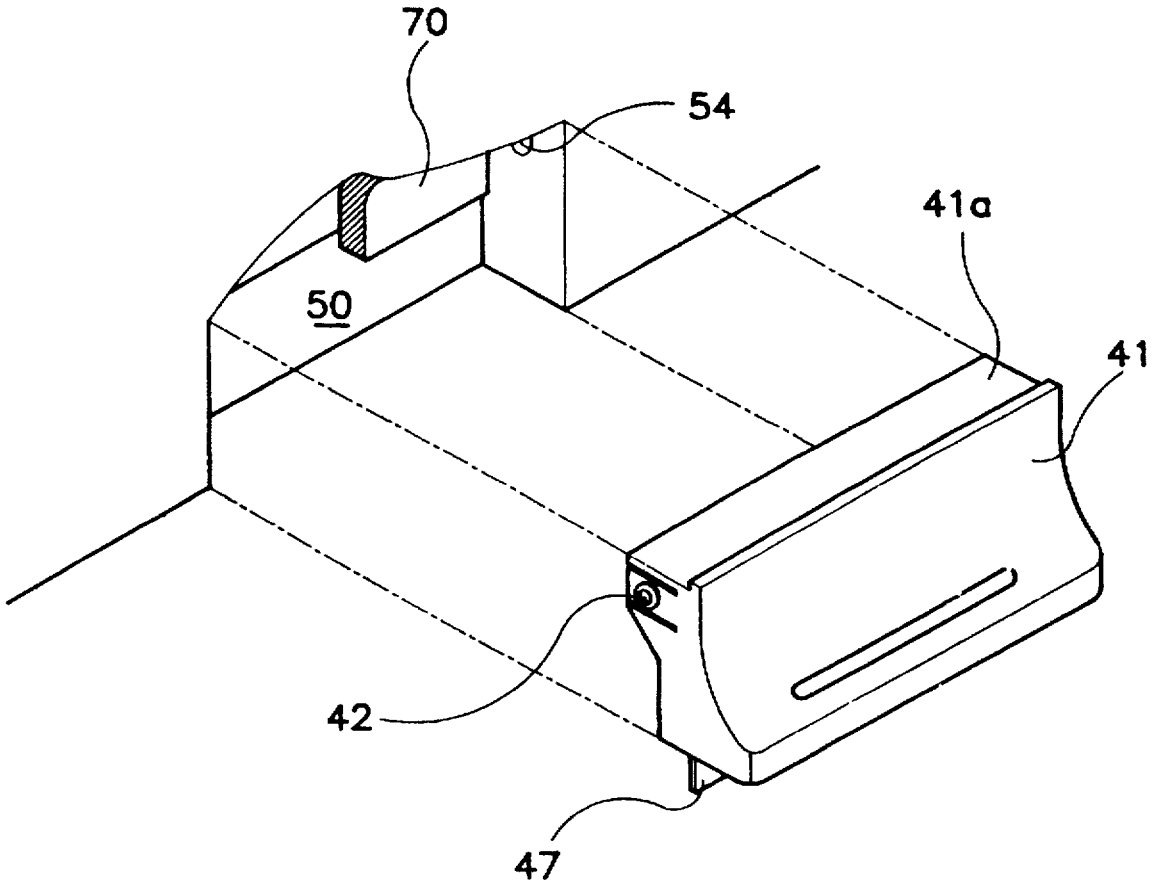
FIG. 4 depicts a partial-perspective view for showing the coupling of a pedal to the lower part of a housing in accordance with the present invention.

A pedal 41 is provided in the recess 50 to operate the reed switch 51. As shown in FIG. 4, pivot pins 42 are respectively formed on both sides of the upper part of the pedal 41. The recess 50 has holes 54 into which the pivot pins 42 are inserted for fastening. The holes 54 are designed as a plot whose upper part is opened. The lower part of the pedal 41 has a free end which slightly protrudes with respect to the outer surface of the housing 10 of the washing machine. A magnet 43 is mounted in the pedal 41 so as to operate the reed switch 51.

When the pedal 41 is pressed to the position of FIG. 3, both contact points of the reed switch 51 come into contact with each other by a magnetic force of the magnet 43 installed in the pedal 41, and allow a signal for opening and closing the door 20 to be applied to the controller 60. The pedal 41 is restored to the original state by a spring 44. In order to install the spring 44, a boss 53 is formed on the inner wall of the recess 50 to protrude to a predetermined length, and a rib 45 is disposed on of the pedal 41.

The spring 44 is a plate spring, and has one end coupled to the boss 53 and the other end elastically pressing the rib 45. On the bottom of the pedal 41 there is provided a vertical protrusion 47 extending toward the bottom of the recess 50 in order to prevent dirt from getting into the recess 50.

As depicted in FIGS. 2 and 4, a guide member 70 is formed inside of the recess 50 and serves to direct the movement of the pedal 41. This guide member 70 is substantially in the shape of a circular-arc, and guides with restraint the upper end 41*a* of the pedal 41 so that the center of rotation of the pedal 41 cannot be changed when the pedal 41 is operated.

In other words, the guide member 70 has the shape of a circular arc so as to correspond with the line of movement of the upper end 41*a* of the pedal 41, and serves to prevent noisy up-and-down movement of the pivot pins 42 within their respective holes 54 and to prevent interference with the movements of the pivot pins 42 and the pedal.

The following description relates to the operation of the inventive apparatus.

When the pedal 41 is pressed with a user's foot in order to open the door 20, the pedal 41 turns on the pivot pins 42 toward the interior of the recess 50 so that the magnet 43 installed in the pedal 41 can come close to the reed switch 51 to exert a magnetic force upon the reed switch, as shown in FIG. 3. Therefore, both of the contact points of the reed switch 51 come into contact with each other by the magnetic force of the magnet 43 disposed near the reed switch 51.

An electric signal generated by the action of the reed switch 51 is indicative of instructions for closing or opening the door 20 of the washing machine, and is transmitted to the controller 60. The controller 60 confirms the opened or closed state of the door 20, e.g. by means of a door position sensor 61 and starts the electric motor 30 to rotate in the compatible direction.

More specifically, when a signal for the opening of the door 20 is input to the controller 60, the controller 60 allows the electric motor 30 to be driven in the direction of making the door 20 open. On the contrary, when a signal for closing of the door 20 is applied to the controller 60, it permits the electric motor 30 to be driven in the opposite direction of the opening mode. According to the operation of the electric motor 30, the rotary member 32 is rotated, with its projections 33 entering the grooves 24 in such a manner that the door 20 of the washing machine is opened and closed. The pedal 41 that was once rotated is restored to its original state by the spring 44.

The guide member 70 guides with restraint the upper end 41*a* of the pedal 41 so as to preclude a variation in the center of rotation of the pedal 41 when the pedal 41 is operated. In other words, the guide member 70 is designed to be in a circular-arc shape to correspond to the path of rotation of the upper end 41*a* of the pedal 41, and the pivot pins 42 can smoothly revolve on their respective axes within the holes 54 to thereby prevent noise and interference during the rotation of the pivot pins 42 and the pedal 41.

As discussed above, since the inventive apparatus for automatically opening and closing the door is provided to the lower part of the washing machine and designed to be controlled by the foot, a user can cause the door of the washing machine to be automatically opened and closed, while holding heavy laundry with his/her hands, and it is very convenient for him/her to use the washing machine.

The guide member is designed in the shape of a circular-arc to thereby correspond to the track of rotation of the upper end of the pedal, and can prevent noise made by the up-and-down movement of the pivot pins within their respective holes as well as interference in the rotation of the pivot pins.

The downward extending protrusion 47 formed on the bottom of the pedal keeps dirt from getting into the recess 50 so as to ensure the correct operation of the pedal and to maintain cleanliness of that part. Besides, the switch of the present invention that transmits a door opening/closing signal is a reed switch which is a non-contact type so that it can be stably operated without breakdown and malfunction caused by a short circuit and bad contacting conditions that the dirt or moisture may create. Instead of the above-mentioned magnetic proximity switch, other common-type contact switches may be employed in the present invention to provide the same function and effect as those of the reed switch.

It will be apparent to those skilled in the art that various modifications and variations can be made in a washing machine with the inventive apparatus for automatically opening and closing the door of the washing machine without departing from the spirit or scope of the invention. Thus, it is intended that the present invention cover the modifications and variations of this invention provided they come within the scope of the appended claims and their equivalents.

What is claimed is:

1. A washing machine comprising:

a housing having a top opening, and a recess formed in a lower portion thereof;

an upwardly open spin basket disposed in the housing;

a door mounted on the housing for opening and closing the top opening;

a motor-driven opening/closing mechanism operably for opening and closing the door; and a signal generating mechanism including a foot pedal mounted on the housing in the recess for providing the opening/closing mechanism with an actuating signal.

2. The washing machine according to claim 1 wherein the signal generating mechanism further comprises a switch for generating an electric signal and arranged to be activated by the manipulator.

3. The washing machine according to claim 2 wherein the foot pedal is mounted to the housing for pivotal movement, and a spring is provided for exerting a return bias on the foot pedal.

4. The washing machine according to claim 3 wherein the foot pedal includes integral pivot pins pivotally mounted in respective holes formed in the housing.

5. The washing machine according to claim 4 wherein the switch comprises a reed switch, and the foot pedal includes a magnet for activating the reed switch.

6. The washing machine according to claim 4 further including a guide surface fixed on the housing and curved along a path corresponding to a path of travel of an adjacent portion of the foot pedal for guiding the travel of that portion of the foot pedal.

7. The washing machine according to claim 6 wherein the holes are in the form of slots, the guide surface preventing the pivot pins from being displaced along the slots.

8. The washing machine according to claim 4 wherein the foot pedal is mounted in a recess formed in the housing and includes a downward projection for resisting the passage of dirt into the recess.

* * * * *